US009027804B2

(12) United States Patent
Barre et al.

(10) Patent No.: US 9,027,804 B2
(45) Date of Patent: May 12, 2015

(54) STACKABLE GARMENT HANGER

(71) Applicant: Neatfreak Group Inc., Mississauga (CA)

(72) Inventors: Bertrand Barre, Lapeyrouse (FR); Francis Lepage, Dommartin (FR)

(73) Assignee: Neatfreak Group Inc., Mississauga, Ontario (CA)

( * ) Notice: Subject to any disclaimer, the term of this patent is extended or adjusted under 35 U.S.C. 154(b) by 66 days.

(21) Appl. No.: 14/036,975

(22) Filed: Sep. 25, 2013

(65) Prior Publication Data

US 2015/0083760 A1 Mar. 26, 2015

(51) Int. Cl.

| | |
|---|---|
| ***A47G 25/14*** | (2006.01) |
| ***A47G 25/28*** | (2006.01) |
| ***A47G 25/32*** | (2006.01) |
| *A47G 25/36* | (2006.01) |

(52) U.S. Cl.

CPC ..... *A47G 25/32* (2013.01)

(58) Field of Classification Search

CPC ... A47G 25/02; A47G 25/14; A47G 25/1442; A47G 25/145; A47G 25/28; A47G 25/36; A41D 27/22; A47F 7/19

See application file for complete search history.

(56) References Cited

U.S. PATENT DOCUMENTS

| | | | | |
|---|---|---|---|---|
| 1,980,557 | A * | 11/1934 | Snitzer | 211/113 |
| 3,191,770 | A * | 6/1965 | Zuckerman | 206/300 |
| 6,050,461 | A | 4/2000 | Batts et al. | |
| D527,536 | S | 9/2006 | McCoy et al. | |
| 7,938,300 | B2 | 5/2011 | Diamond et al. | |
| D656,325 | S * | 3/2012 | Ho | D6/319 |
| 2003/0222108 | A1* | 12/2003 | Gouldson et al. | 223/91 |
| 2008/0197160 | A1 | 8/2008 | Lee | |
| 2012/0138641 | A1* | 6/2012 | Yamada | 223/85 |
| 2013/0221040 | A1* | 8/2013 | Wright et al. | 223/85 |

* cited by examiner

*Primary Examiner* — Ismael Izaguirre
(74) *Attorney, Agent, or Firm* — Patzik, Frank & Samotny Ltd.

(57) ABSTRACT

A stackable garment hanger is configured to stack vertically, with successive hangers being positioned in an undulating, back-and-forth manner. At least a portion of each garment hanger nests within the outline of the next garment hanger in a vertical stack of identical garment hangers. The front and back garment hangers may be substantially mirror images of each other. The garment hanger includes at least one pair of binding slots extending therethrough and separated by a predetermined distance that coincides with the up-and-down, undulating offset distance between each adjacent, nested and stacked garment hanger. In this manner, a coaxial opening or continuous channel is formed through the alternating, successive alignment of an upper slot an adjacent lower slot, a further adjacent upper slot, and so forth.

7 Claims, 4 Drawing Sheets

STACKABLE GARMENT HANGER

BACKGROUND OF THE INVENTION

1. Field of the Invention

The present invention relates, in general, to garment hangers and, more particularly, to garment hangers wherein multiple instances of the hangers are capable of securely and neatly stacking together.

2. General Background of the Invention

Garment hangers for supporting and hanging articles of clothing from a closet rod or similar cylindrical support have been known for quite some time. Today, such hangers are often made of a plastic material, and are packaged, transported, and displayed on retail shelves for sale in bulk, such as in groups of ten or twenty hangers of like design.

Some prior art hangers, such as the one disclosed in U.S. Pat. No. D527,536 to McCoy et al., are made to stack precisely on top of each other. Designs such as these employ a protruding surface on one side that is received within a corresponding recess on a reverse side of the hanger. As a result, these types of stacking hangers can be relatively think and heavy in construction, and require relatively asymmetrical-appearing opposing surfaces.

BRIEF SUMMARY OF THE INVENTION

The present invention provides stackable garment hangers that overcomes may of the shortcomings of certain prior art stackable garment hangers. In particular, stackable garment hangers are disclosed that permits a stack of such hangers to be stacked and secured adjacent each other relatively tightly, taking less vertical space than certain prior art hangers. Moreover, stackable garment hangers are disclosed having strategically located protruding and recessed regions that enable the hangers to be stacked tightly adjacent each other in an undulating, back-and-forth, offset arrangement. In addition, stackable garment hangers are provided that includes adjacent pairs of binding slots, configured such that, as a stack of hangers is arranged in an undulating, back-and-forth, offset arrangement, a single coaxial opening or channel is created through the stack of hangers via the binding slots in order to accept a binding member in order to fully secure the stack of hangers together.

DETAILED DESCRIPTION OF THE INVENTION

Figure 1:
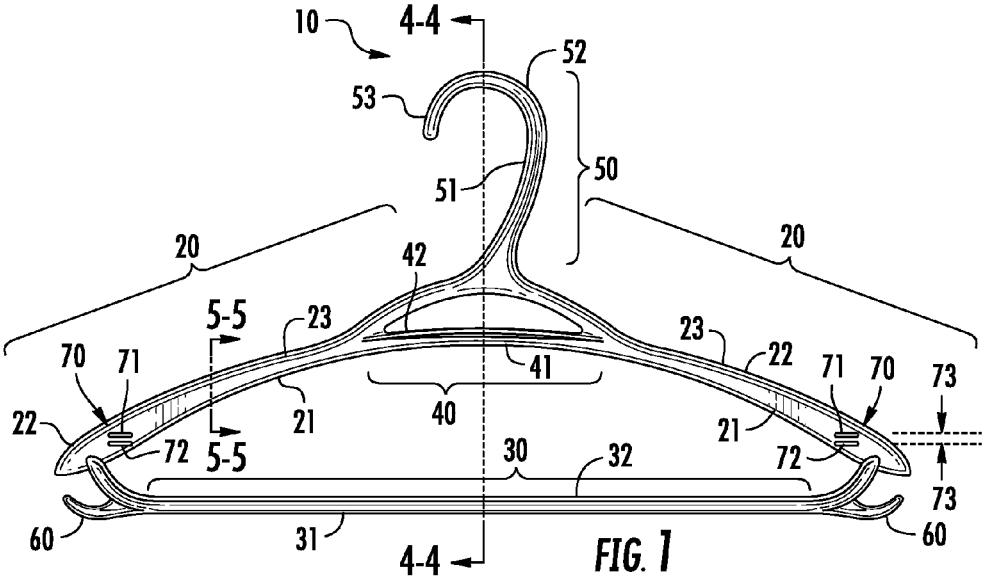
FIG. 1 an elevated, front view of a first embodiment of a stackable garment hanger of the present invention.
Figure 2:
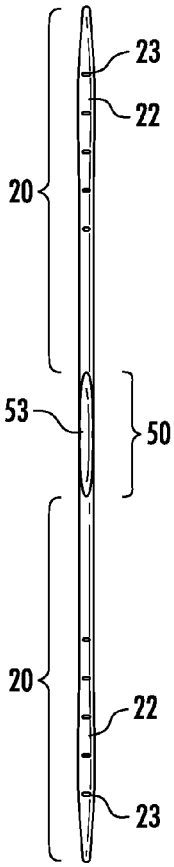
FIG. 2 is a top plan view of the stackable garment hanger of FIG. 1.

While the present invention is susceptible of embodiment in many different forms, there is shown in the drawings and will herein be described in detail, several specific embodiments, with the understanding that the present disclosure is intended as an exemplification of the principles of the present invention and is not intended to limit the invention to the embodiments illustrated.

A first embodiment 10 of the present stackable garment hanger invention, configured and sized for supporting and hanging adult-sized articles of clothing, is shown in FIGS. 1-5 as comprising two opposing shoulder regions 20, pant bar 30, upper crossbar 40, top hook 50, two opposing strap hooks 60, and binding slots 70. While a front side of stackable hanger 10 is shown in FIG. 1, the back side is substantially a mirror image thereof and is accordingly not shown in an additional figure.

Shoulder region 20 includes substantially planar, arcuate lower region 21 and protruding or raised upper lip or periphery region 22. Raised periphery region 22 extends across substantially the entire length of shoulder region 20, from a distal end above strap hook 60 to the junction of shoulder region 20 with top hook 50. A series of protruding ribs 23 are disposed transversely across the upper surface of each shoulder region 20, in order to inhibit any unwanted slipping of garments supported by shoulder region 20. Alternatively, a substantially non-slip material, with or without similar protruding ribs, may be overmolded or otherwise affixed to the upper surface of each shoulder region 20.

Upper crossbar 40 includes substantially planar, arcuate lower region 41 and protruding or raised upper lip or periphery region 42. Upper lip or periphery region 42 is substantially aligned along an arc extending across both protruding or raised upper lips or periphery regions 22 of both shoulder regions 20, thereby effectively extending the arc across the majority of the length of stackable garment hanger 10.

Top hook 50 includes protruding or raised inner edge 51, protruding or raised outer edge 52, and tapered upper arcuate region 53. Raised inner edge 51 extends substantially continuously from proximate a distal tip at the opening of top hook 50, around the arcuate inner surface of top hook 50 to the junction of top hook 50 with one of shoulder regions 20, seamlessly joining raised periphery region 22 of shoulder region 20. Raised outer edge 52 of top hook 50 extends from proximate the outer apex of top hook 50, about the outer periphery of top hook 50 to the junction of top hook 50 with the other one of shoulder regions 20, seamlessly joining raised periphery region 22 of shoulder region 20. Tapered upper arcuate region 53 of top hook 50 extends about the outer edge of top hook 50, from the outer apex to the distal tip at the opening of top hook 50.

Pant bar 30 includes substantially planar, linear lower region 31 and protruding or raised upper lip or periphery region 32. As best seen in FIG. 1, pant bar 30 curves upward at opposing ends, as it joins opposing shoulder regions 20. Raised periphery region 32 extends across substantially the entire length of pant bar 30, to the junctions of pant bar 30 with opposing shoulder regions 20.

A strap hook 60 extends from each opposing juncture of a shoulder region 20 with pant bar 40, and is capable of supporting both the shoulder straps of certain garments, as well as dedicated hanging loops sewn or otherwise provided with certain garments, such as certain dresses.

Figure 4:
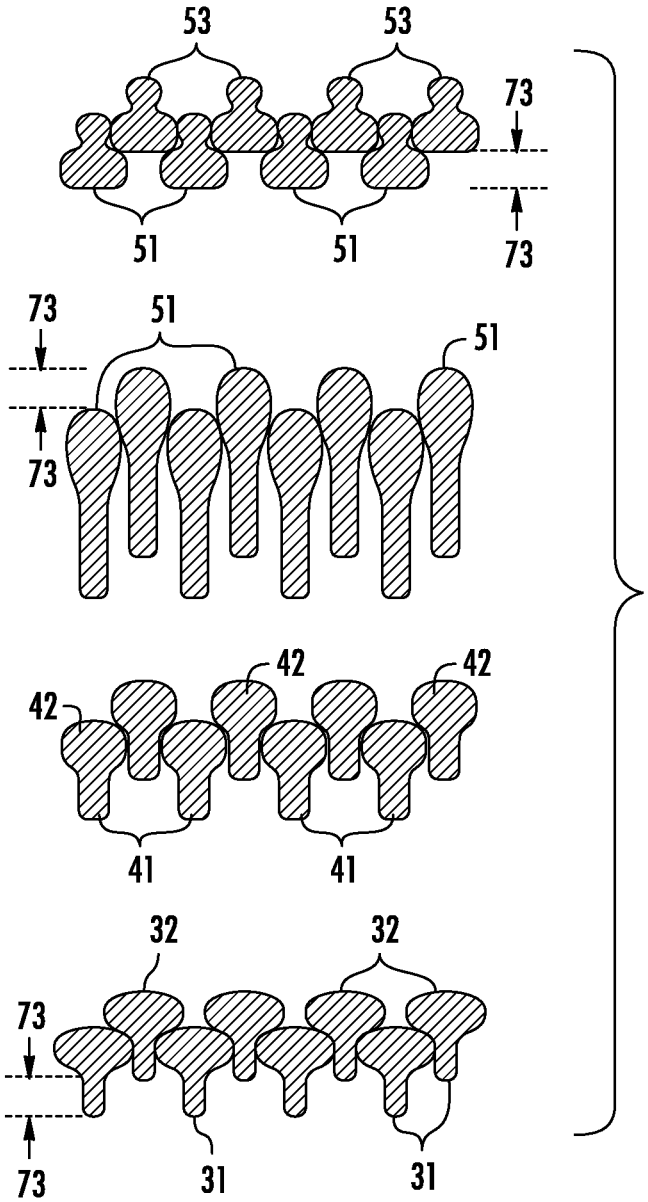
FIG. 4 is a sectional view illustrating a stack of eight of the stackable garment hangers of FIG. 1, taken generally along line 4-4 of FIG. 1.
Figure 5:
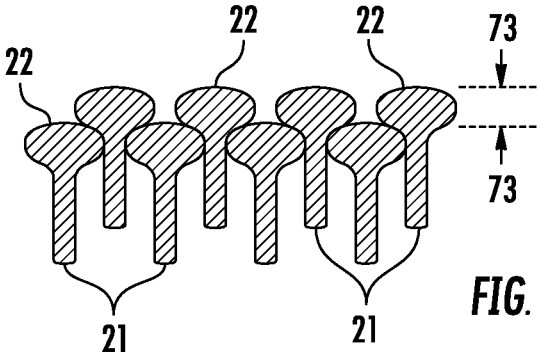
FIG. 5 is a sectional view illustrating a stack of eight of the stackable garment hangers of FIG. 1, taken generally along line 5-5 of FIG. 1.

As best seen in FIG. 1, each opposing shoulder region 20 includes a pair of binding slots 70 extending through substantially planar arcuate lower region 21. In particular, upper slot 71 and lower slot 72 are vertically aligned. Moreover, the longitudinal axes of upper slot 71 and lower slot 72 are separated by a predetermined inter-slot distance 73 that, as best seen in FIGS. 4 and 5, coincides with the up-and-down, undulating offset distance between each adjacent, nested and stacked garment hanger 10. In this manner, upper slot 71 of a first garment hanger 10 will align vertically with lower slot 72 of a second stacked garment hanger 10. Moreover, these aligned slots will continue to align vertically with upper slot 71 of a third stacked garment hanger 10. Moreover, these aligned slots will continue to align vertically with lower slot 72 of a fourth stacked garment hanger 10, and so forth. In this manner, regardless of the number of garment hangers 10 that are stacked, a continuous coaxial opening or channel is formed through the alternating, successive alignment of upper slot 71, and adjacent lower slot 72, a further adjacent upper slot 71, and so forth. A substantially flat plastic material, a wire tie, or other suitable fastener may then be passed through this open channel extending through all of the vertically stacked and nested garment hangers 10 to fully secure them in their nested and stacked orientation.

Figure 3:
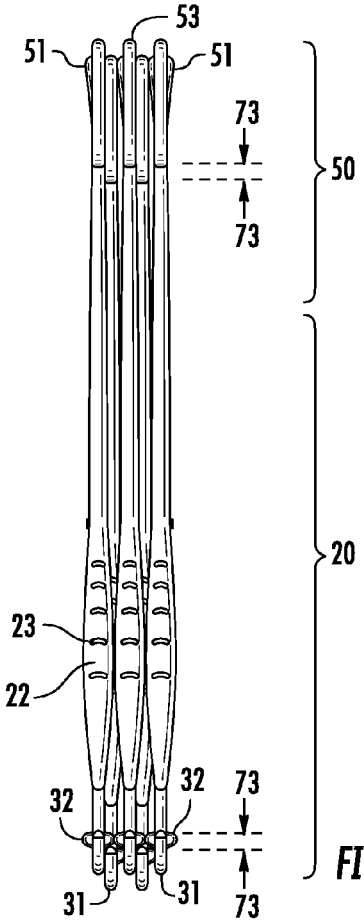
FIG. 3 is an elevated, front view of a stack of five of the stackable garment hangers of FIG. 1.

As best seen in FIGS. 3 through 5, garment hangers 10 may be vertically stacked in an up-and-down, undulating orientation, with each adjacent hanger 10 being offset from each other by an amount corresponding to inter-slot distance 73. Moreover, adjacent hangers 10 are effectively nested together as they are stacked, with protruding or raised lip regions of one hanger being nestled against a planar region of corresponding structure of the adjacent hanger while, at the same time, abutting the protruding or raised lip regions of corresponding structure of the adjacent hanger. For example, as shown in FIG. 4, in adjacently stacked hangers 10, raised upper lip or periphery region 32 of a pant bar 30 of first hanger 10 is nestled partially within the outline of an adjacent, second hanger 10, with raised upper lip or periphery region 32 of the first hanger 10 contacting substantially planar linear lower region 31 of the second hanger 10, and with raised upper lip or periphery region 32 of the first hanger 10 abutting raised upper lip or periphery region 32 of the second hanger 10. At the same time, raised upper lip or periphery region 42 of an upper crossbar of first hanger 10 is nestled partially within the outline of adjacent second hanger 10, with raised upper lip or periphery region 42 of the first hanger 10 contacting substantially planar arcuate lower region 41 of the second hanger 10, and with raised upper lip or periphery region 42 of the first hanger 10 abutting raised upper lip or periphery region 42 of the second hanger 10. Moreover, at the same time, raised inner edge 51 of a top hook 50 of the first hanger is nestled partially within the outlined of adjacent second hanger 10, with raised inner edge 51 of the first hanger 10 contacting tapered arcuate region 53 of the second hanger 10, and with raised inner edge 51 of the first hanger 10 abutting raised inner edge 51 of the second hanger 10. Furthermore, at the same time, raised upper lip or periphery region 22 of a shoulder region 20 of first hanger 10 is nestled partially within the outline of adjacent second hanger 10, with raised upper lip or periphery region 22 of the first hanger 10 contacting substantially planar arcuate lower region 21 of the second hanger 10, and with raised upper lip or periphery region 22 of the first hanger 10 abutting raised upper lip or periphery region 22 of the second hanger 10.

Moreover, when multiple hangers 10 are nested and stacked together as described above and then further secured together by advancing a strap or other fastener through binding slots 70, the contact of adjoining raised lips or periphery regions of adjacent hangers 10, such as adjoining raised upper lip or periphery regions 22, 32 and 42, as well as the contact of adjoining raised inner edges 51 of top hooks 50, serve to inhibit relative rotation or other slipping of adjacent hangers 10, further maintaining the hangers in their nested and stacked orientation.

Figure 6:
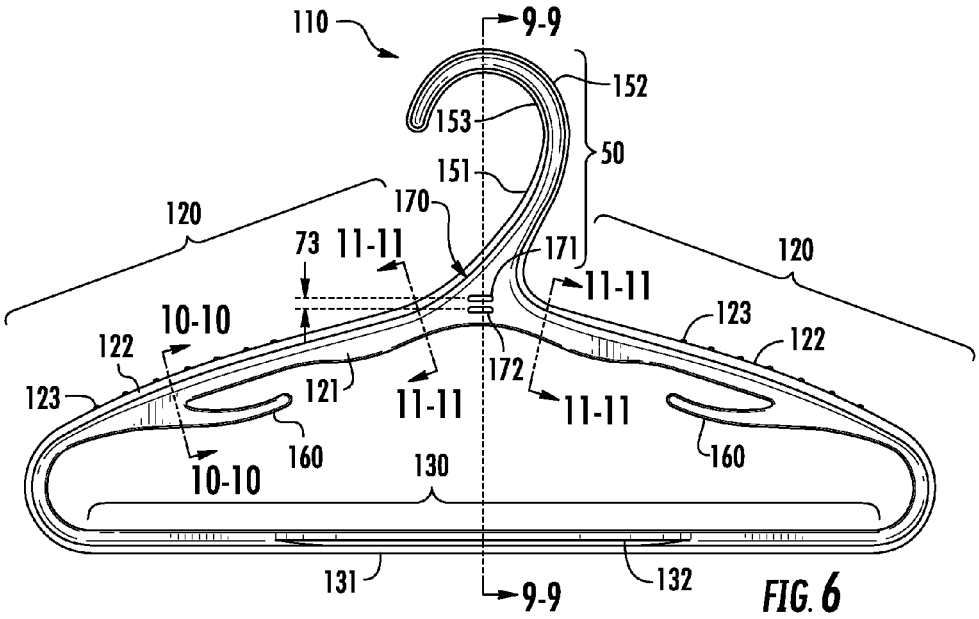
FIG. 6 an elevated, front view of a second embodiment of a stackable garment hanger of the present invention.
Figure 7:
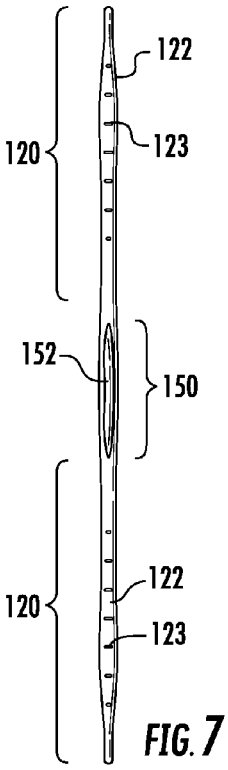
FIG. 7 is a top plan view of the stackable garment hanger of FIG. 6.

A second embodiment 110 of the present stackable garment hanger invention, configured and sized for supporting and hanging child-sized articles of clothing, is shown in FIGS. 6-11 as comprising two opposing shoulder regions 120, pant bar 130, top hook 150, two opposing strap hooks 160, and binding slots 170. While a front side of stackable hanger 110 is shown in FIG. 6, the back side is substantially a mirror image thereof and is accordingly not shown in an additional figure.

Shoulder region 120 includes substantially planar, arcuate lower region 121 and protruding or raised upper lip or periphery region 122. Raised periphery region 122 extends across substantially the entire length of shoulder region 120, from a distal arcuate end joining pant bar 130 to the junction of shoulder region 120 with top hook 150. A series of protruding ribs 123 are disposed transversely across the upper surface of each shoulder region 120, in order to inhibit any unwanted slipping of garments supported by shoulder region 120. Alternatively, a substantially non-slip material, with or without similar protruding ribs, may be overmolded or otherwise affixed to the upper surface of each shoulder region 120.

Top hook 150 includes protruding or raised inner edge 151, protruding or raised outer edge 152, and tapered upper arcuate region 153. Raised inner edge 151 extends substantially continuously from proximate a distal tip at the opening of top hook 150, around the arcuate inner surface of top hook 150 to the junction of top hook 150 with one of shoulder regions 120, seamlessly joining raised periphery region 122 of shoulder region 120. Raised outer edge 152 of top hook 50 extends from proximate the outer apex of top hook 150, about the outer periphery of top hook 150 to the junction of top hook 150 with the other one of shoulder regions 120, seamlessly joining raised periphery region 122 of shoulder region 120. Tapered upper arcuate region 153 of top hook 150 extends about the outer edge of top hook 50, from the outer apex to the distal tip at the opening of top hook 150.

Pant bar 130 includes substantially planar, linear lower region 131 and protruding or raised upper lip or periphery region 132. As best seen in FIG. 6, pant bar 130 curves upward at opposing ends, as it joins corresponding curved ends of opposing shoulder regions 120. Raised periphery region 132 extends across approximately one half of the length of pant bar 132, is centered horizontally about a midpoint of pant bar 130, and tapers away at opposing ends of raised periphery region 132.

A strap hook 160 extends from each opposing substantially flat arcuate lower region 131, and is capable of supporting both the shoulder straps of certain garments, as well as dedicated hanging loops sewn or otherwise provided with certain garments, such as certain dresses.

Figure 9:
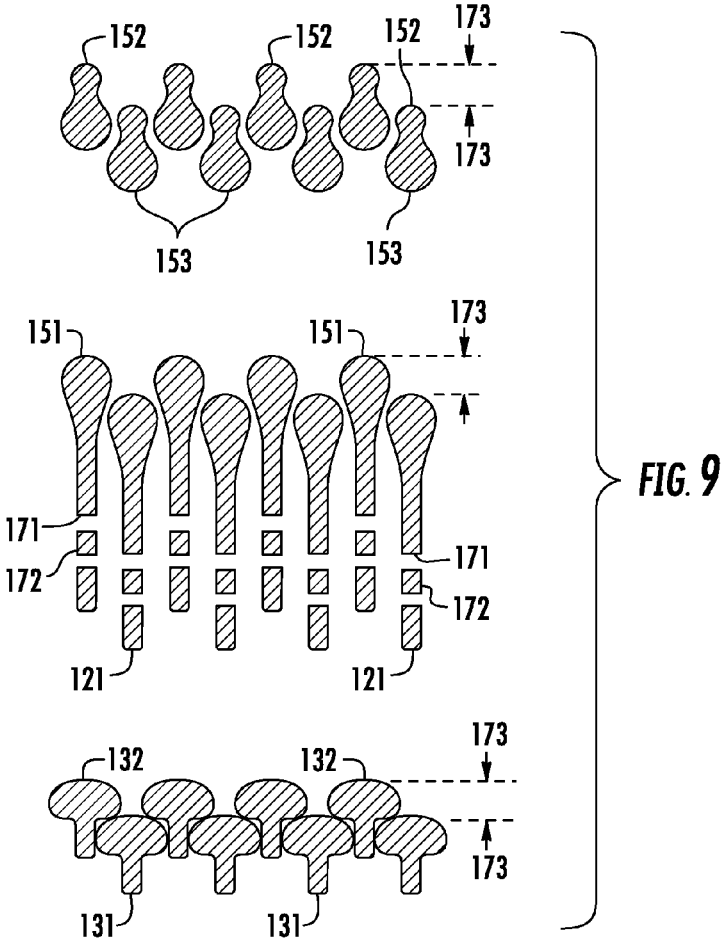
FIG. 9 is a sectional view illustrating a stack of eight of the stackable garment hangers of FIG. 6, taken generally along line 9-9 of FIG. 1.
Figure 10:
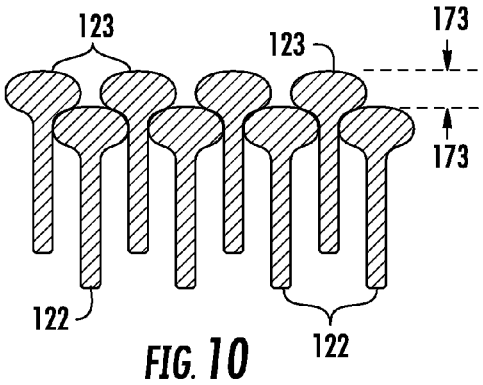
FIG. 10 is a sectional view illustrating a stack of eight of the stackable garment hangers of FIG. 6, taken generally along line 10-10 of FIG. 6.
Figure 11:
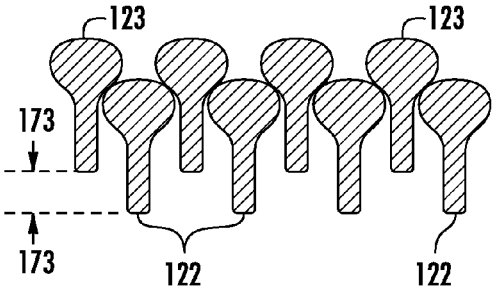
FIG. 11 is a sectional view illustrating a stack of eight of the stackable garment hangers of FIG. 6, taken generally along line 11-11 of FIG. 6.

As best seen in FIG. 6, hanger 120 includes a pair of binding slots 170 extending through the juncture of the two substantially planar arcuate lower regions 121. In particular, upper slot 171 and lower slot 172 are vertically aligned. Moreover, the longitudinal axes of upper slot 171 and lower slot 172 are separated by a predetermined inter-slot distance 173 that, as best seen in FIGS. 9 and 10, coincides with the up-and-down, undulating offset distance between each adjacent, nested and stacked garment hanger 110. In this manner, upper slot 171 of a first garment hanger 110 will align vertically with lower slot 172 of a second stacked garment hanger 110. Moreover, these aligned slots will continue to align vertically with upper slot 171 of a third stacked garment hanger 110. Moreover, these aligned slots will continue to align vertically with lower slot 172 of a fourth stacked garment hanger 110, and so forth. In this manner, regardless of the number of garment hangers 110 that are stacked, a coaxial opening or continuous channel is formed through the alternating, successive alignment of upper slot 171, and adjacent lower slot 172, a further adjacent upper slot 171, and so forth. A substantially flat plastic material, a wire tie, or other suitable fastener may then be passed through this open channel extending through all of the vertically stacked and nested garment hangers 110 to fully secure them in their nested and stacked orientation.

Figure 8:
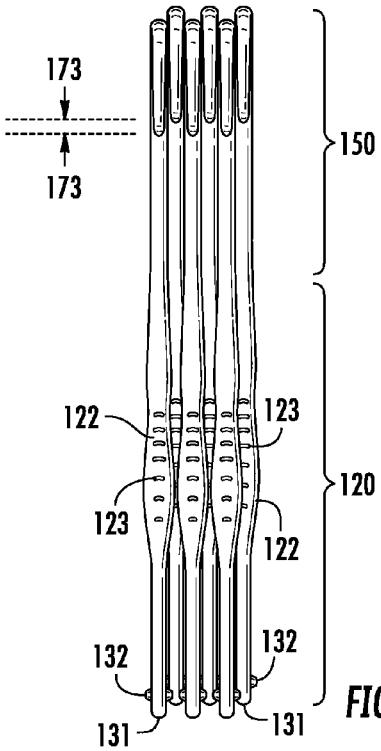
FIG. 8 is an elevated, front view of a stack of six of the stackable garment hangers of FIG. 6.

As best seen in FIGS. 8 through 10, garment hangers 110 may be vertically stacked in an up-and-down, undulating orientation, with each adjacent hanger 110 being offset from each other by an amount corresponding to inter-slot distance 173. Moreover, adjacent hangers 110 are effectively nested together as they are stacked, with protruding or raised lip regions of one hanger being nestled against a planar region of corresponding structure of the adjacent hanger while, at the same time, abutting the protruding or raised lip regions of corresponding structure of the adjacent hanger. For example, as shown in FIG. 9, in adjacently stacked hangers 110, raised upper lip or periphery region 132 of a pant bar 130 of first hanger 110 is nestled partially within the outline of an adjacent, second hanger 110, with raised upper lip or periphery region 132 of the first hanger 110 contacting substantially planar linear lower region 131 of the second hanger 110, and with raised upper lip or periphery region 132 of the first hanger 110 abutting raised upper lip or periphery region 132 of the second hanger 110. At the same time, raised inner edge 153 of a top hook 150 of the first hanger 110 is nestled partially within the outlined of adjacent second hanger 110, with raised inner edge 151 of the first hanger 110 contacting tapered arcuate region 153 of the second hanger 110, and with raised inner edge 151 of the first hanger 10 abutting raised inner edge 151 of the second hanger 10. Moreover, at the same time, raised upper lip or periphery region 122 of a shoulder region 120 of first hanger 110 is nestled partially within the outline of adjacent second hanger 110, with raised upper lip or periphery region 122 of the first hanger 110 contacting substantially planar arcuate lower region 121 of the second hanger 110, and with raised upper lip or periphery region 122 of the first hanger 110 abutting raised upper lip or periphery region 122 of the second hanger 110.

Moreover, when multiple hangers 110 are nested and stacked together as described above and then further secured together by advancing a strap or other fastener through binding slots 170, the contact of adjoining raised lips or periphery regions of adjacent hangers 110, such as adjoining raised upper lip or periphery regions 122 and 132, as well as the contact of adjoining raised inner edges 151 of top hooks 150, serve to inhibit relative rotation or other slipping of adjacent hangers 110, further maintaining the hangers in their nested and stacked orientation.

Hangers of the present invention may be constructed of a polypropylene material. As a result of their configuration enabling a nesting, stacked arrangement as described above, a packaged stack of hangers of the present invention may consume up to 30% less space, when compared to a conventional round tubular profiled garment hanger constructed of similar materials.

Many modifications and variations of the present invention are possible in light of the above teachings. It is therefore to be understood that within the scope of the appended claims, the invention may be practiced other than as specifically described. Various modifications, changes and variations may be made in the arrangement, operation and details of performing the various steps of the invention disclosed herein without departing from the spirit and scope of the invention. The present disclosure is intended to exemplify and not limit the invention.

What is claimed is:

1. A stackable garment hanger, comprising:

a hook; and two shoulder regions, each of the shoulder regions being disposed on opposing sides of the hook and having an elongated, substantially planar region having a front surface, a rear surface, and an elongated edge, a raised periphery region extending along at least a portion of the edge of each planar region, each raised periphery region being raised relative to both the front and rear surfaces of an associated planar region of an associated shoulder region;

wherein at least a portion of the stackable garment hanger is configured to nest within at an outline of at least a portion of another, identically designed garment hanger when the garment hanger and the identically designed garment hanger are stacked vertically; and wherein multiple instances of the stackable garment hanger are vertically stackable in a back-and-forth, undulating manner, with at least a portion of each instance of a stackable garment hanger nesting within an outline of a successive stackable garment hanger within an overall stack of stackable garment hangers.

2. The invention according to claim 1, wherein the stackable garment hanger further includes at least two apertures extending through a portion of the garment hanger, the two apertures being separated by a distance substantially corresponding to an offset distance between adjacent instances of the stackable garment hanger when multiple stackable garment hangers are stacked vertically in the undulating, back-and-forth orientation.

3. The invention according to claim 2, wherein a coaxial opening extends through only one of the two apertures of each stackable garment hangers when a plurality of stackable garment hangers are stacked in the undulating, back-and-forth orientation.

4. The invention according to claim 1, wherein the stackable garment hanger has a front side and a rear side, the rear side being substantially a mirror image of the front side.

5. The invention according to claim 1, further comprising a pant bar having an elongated, substantially planar region having a front surface, a rear surface, and an elongated edge, a raised periphery region extending along at least a portion of the edge of the substantially planar region, the raised periphery region being raised relative to both the front and rear surfaces of the planar region of the pant bar.

6. The invention according to claim 1, further comprising a crossbar having an elongated, substantially planar region having a front surface, a rear surface, and an elongated edge, a raised periphery region extending along at least a portion of the edge of the substantially planar region, the raised periphery region being raised relative to both the front and rear surfaces of the planar region of the crossbar.

7. The invention according to claim 1, wherein the hook includes a substantially planar region having a front surface, a rear surface, and an elongated edge, a raised periphery region extending along at least a portion of the edge of the hook, the raised periphery region being raised relative to both the front and rear surfaces of the planar region of the hook.

* * * * *